US005201869A

United States Patent [19]

Roethel

[11] Patent Number: 5,201,869

[45] Date of Patent: Apr. 13, 1993

[54] DISPENSER FOR CUPS AND CUP-LIKE ARTICLES

[75] Inventor: Henry G. Roethel, Ravenna, Ohio

[73] Assignee: The Meyer Company, Cleveland, Ohio

[21] Appl. No.: 755,093

[22] Filed: Sep. 5, 1991

[51] Int. Cl.[5] ..... A47F 1/08

[52] U.S. Cl. ..... 221/304; 221/307

[58] Field of Search ..... 221/304, 307, 308, 63, 221/283, 287

[56] References Cited

U.S. PATENT DOCUMENTS

| | | | |
|---|---|---|---|
| 1,131,255 | 3/1915 | Luellen | 221/310 X |
| 1,155,562 | 10/1915 | Gilchrist | 221/307 X |
| 1,762,975 | 6/1930 | Getz | 221/63 X |
| 1,808,284 | 6/1931 | Bergmann | 221/307 X |
| 2,543,746 | 3/1951 | Morrison | 221/307 |
| 3,108,714 | 10/1963 | O'Brien | 221/308 X |
| 3,211,329 | 10/1965 | Boyd | 221/308 X |
| 4,372,465 | 2/1983 | Alcorn | 221/310 X |
| 4,476,996 | 10/1984 | Moore, Jr. et al. | 221/63 X |
| 4,925,058 | 5/1990 | Ozawa | 221/307 X |
| 5,067,633 | 11/1991 | Grosz et al. | 221/307 X |

*Primary Examiner*—Robert P. Olszewski
*Assistant Examiner*—Dean A. Reichard
*Attorney, Agent, or Firm*—Fay, Sharpe, Beall, Fagan, Minnich & McKee

[57] ABSTRACT

An apparatus for storing a supply of cup-shaped containers in a stacked, telescopically interfitted relationship comprises a tubular housing with a resilient diaphragm across the lower end. The diaphragm has a center opening through which the lowermost container extends. The diaphragm acts to retain the stack in the housing while permitting the lowermost container to be withdrawn. According to the invention, the diaphragm comprises a unitary piece of resilient, elastomeric material with the diaphragm having a resistance to elongation in directions circumferentially of the opening which increases progressively radially outwardly of the opening.

20 Claims, 5 Drawing Sheets

FIG. 7
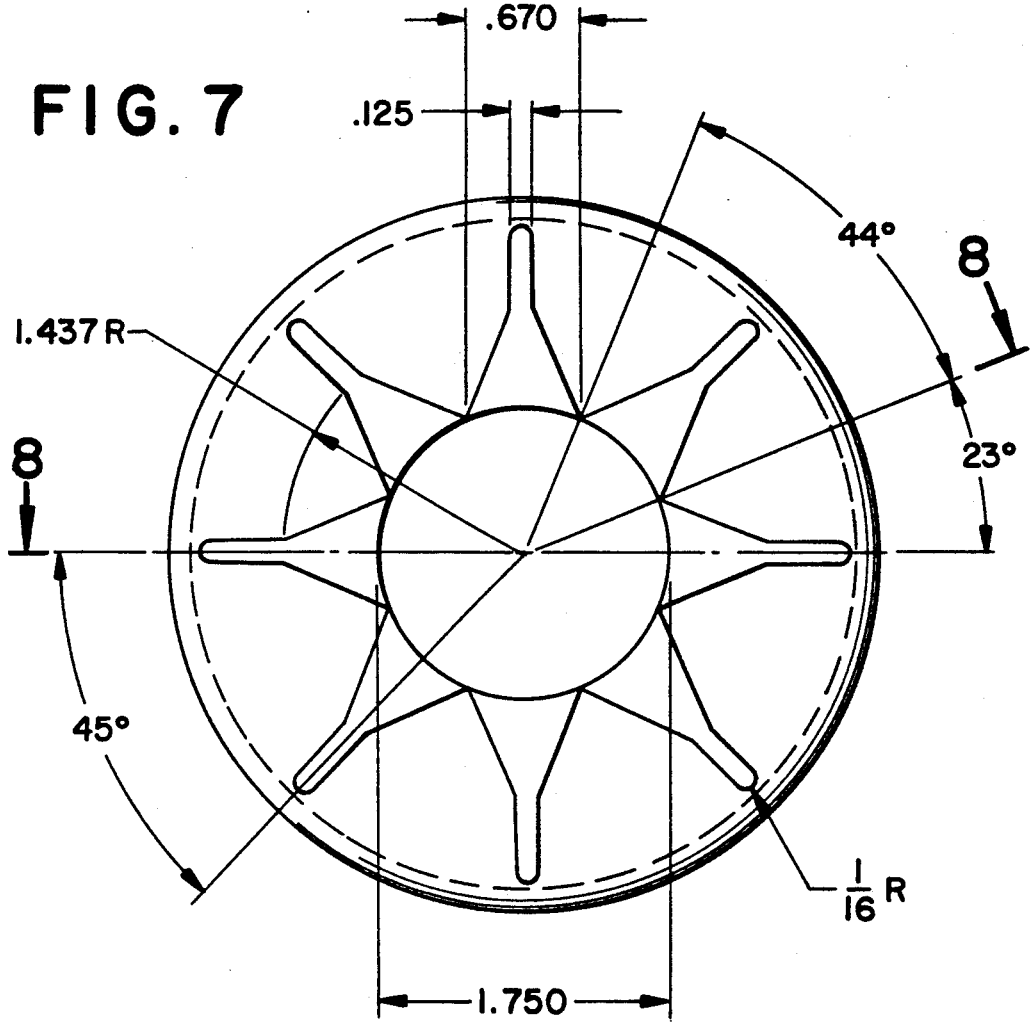
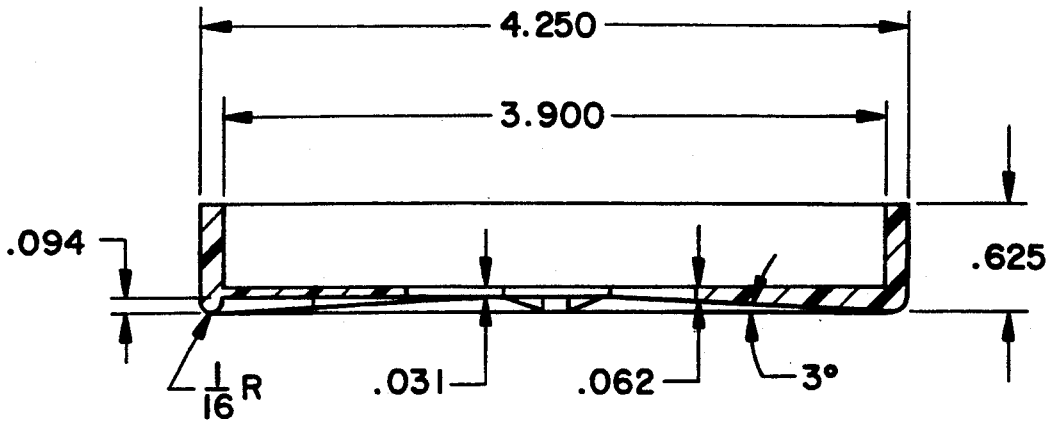
FIG. 8

DISPENSER FOR CUPS AND CUP-LIKE ARTICLES

BACKGROUND OF THE INVENTION

The subject invention is directed toward the art of cup dispensers and, more particularly, to a diaphragm type cup dispenser assembly and an improved diaphragm therefor which is capable of handling an extremely large range of cup sizes.

Cup dispensers of the type under consideration are commonly used in the fast food industry to maintain a supply of cups adjacent the beverage dispensing equipment for use as required. The dispensers typically comprise a storage tube or cylinder which holds a telescopically interfitted stack of cups. Across the lower end of the tube, there is a resilient diaphragm having a central opening through which the bottom portion of the lowermost cup in the stack extends. The diaphragm resiliently grips and holds the lowermost cup and thereby supports it and the telescopically interfitted stack thereabove. As the lowermost cup is pulled through the diaphragm opening, the diaphragm grips the next superjacent cup in the stack to hold it and the stack as the lowermost cup is removed.

As can be appreciated, the resiliency of the diaphragm and the diameter of the central opening generally act as the limiting factors with respect to the range of cup diameters that can be handled by any single diaphragm. Typically, a large number of different diaphragms must generally be provided in order to properly hold the usual range of cup sizes. Similarly, different diaphragms must be used for fragile cups or ice cream cones. Alternative designs using mechanical spring fingers and the like have been proposed. These have also been limited in the range of sizes they can handle.

BRIEF DESCRIPTION OF THE INVENTION

The subject invention provides a dispensing apparatus of the general type described wherein the diaphragm member has an improved design which allows it to function with a greater range of cup sizes. In addition, the same diaphragm member can suitably dispense relatively rigid plastic cups as well as delicate and fragile containers such as ice cream cones. Because of the wider range of cup types and sizes which any one size of diaphragm member can handle, the number of different sizes of diaphragms which must be manufactured and inventoried is greatly reduced. This greatly simplifies both manufacture and use.

In accordance with the subject invention, there is provided an apparatus for storing and dispensing a supply of containers in a telescopically interfitted stacked relationship. The apparatus generally comprises an elongated tubular housing for maintaining the containers vertically aligned in their stacked telescopically interfitted relationship. The housing includes a resilient diaphragm extending across its lower end with an opening through which the lowermost container of the stack can extend. The diaphragm acts to retain the stack in the housing while permitting the lowermost container to be withdrawn. The invention provides the improvement wherein the diaphragm comprises a unitary piece of resilient elastomeric material arranged and contoured so that the diaphragm has a resistance to elongation in directions circumferentially of the opening which resistance increases progressively radially outward of the opening.

Preferably, and in accordance with a preferred embodiment of the invention, the resistance to elongation results from forming the diaphragm such that the average thickness in circumferential bands about the opening increases progressively radially outward of the opening. One manner of achieving this increase in average thickness is by forming the diaphragm such that it is comprised of alternately relatively thick and relatively thin radially extending bands with the relatively thicker bands tapering from a relatively narrow point adjacent the opening to a relatively wider section at locations radially spaced from the opening.

When the apparatus is formed in the manner described, it is capable of handling cups throughout a wide range of diameters. It is believed that the greatly improved ability to function throughout a wide range of cup diameter results from the increasing resistance to elongation exhibited by the diaphragm as it progresses radially outward. This results in increased pressure at radially outward spaced locations. As a consequence, as the lowermost cup in the stack is pulled downwardly, the diaphragm places an increased pressure on the rim of the next superposed cup to grip and holds it as the lowermost cup is withdrawn. Additionally, the progressive increase in pressure radially outward assures that there is a differing low pressure for the smaller, delicate cups as compared to the larger and more rigid cups.

It has also been found that with the above arrangement of the diaphragm, the system can be used to dispense cups having an asymmetrical upper lip. This type of cup is sometimes used for serving french fries and similar food products. The arrangement of the diaphragm results in an increased pressure and transfer of the pressure from the lip of the withdrawn cup to the next cup in line as the asymmetrical edge is pulled through the diaphragm center opening.

As is apparent from the foregoing, a primary object of the invention is the provision of a cup dispensing apparatus of the general type described which is capable of readily handling a wide variety of sizes and types of containers or cup members without changing the diaphragm dimensions and construction.

A still further object of the invention is the provision of an apparatus for dispensing cups in which the diaphragm which retains the cups in their stacked relationship and exhibits an ability to engage and retain cups ranging from small and delicate cones to relatively large and rigid plastic containers.

A still further object is the provision of a diaphragm structure which can be molded as a single unitary element and which does not require any special springs, levers, or associated structure.

A still further object is the provision of a cup or container dispensing apparatus wherein a single diaphragm is all that is required to perform the dispensing function.

BRIEF DESCRIPTION OF THE DRAWINGS

The above and other objects and advantages will become apparent from the following description when read in conjunction with the accompanying drawings wherein:

FIG. 7 is a plan view of one specific dimensioned embodiment of the inventive diaphragm;

FIG. 8 is a cross-sectional view taken on line 8—8 of FIG. 7;

DETAILED DESCRIPTION OF THE PREFERRED EMBODIMENT

Figure 1:
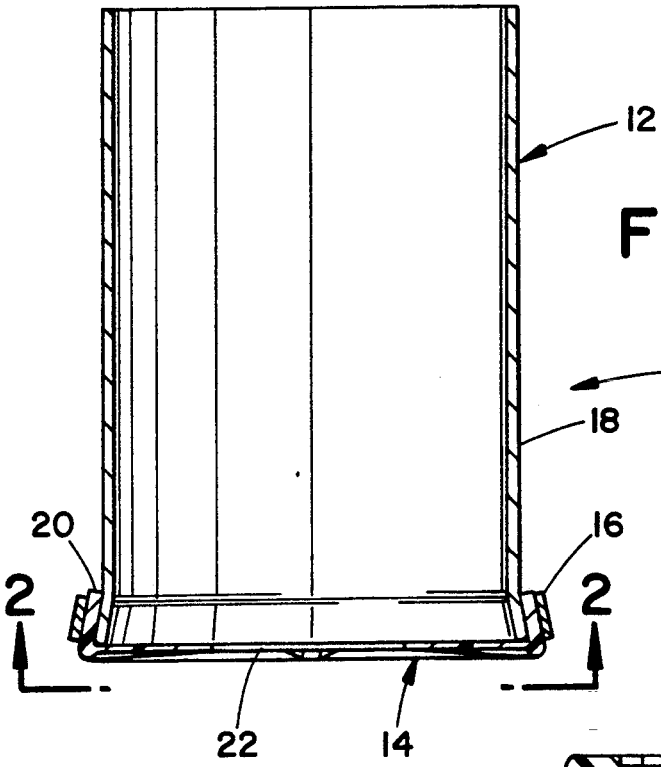
FIG. 1 is a cross-sectional view through a preferred embodiment of cup dispensing apparatus of the type under consideration.

Referring more particularly to the drawings wherein the showings are for purposes of illustrating a preferred embodiment of the invention, FIG. 1 shows the overall arrangement of a cup storage and dispensing apparatus 10 which generally comprises a main housing 12 having a diaphragm member 14 extending across the lower end thereof and retained thereon in any convenient manner such as by a suitable clamp ring member 16. The housing 12 could have a variety of constructions but is shown as a simple, open ended tubular member 18 formed from stainless steel or the like and having a generally cylindrical shape. As is known, the tubular member 18 could be adjustable in diameter if desired. In any event, its diameter is sufficient so as to allow it to store a supply of containers or cups in a stacked, telescopically interfitted relationship such as in the manner illustrated in FIG. 5. The cups are maintained in the stacked and interfitted relationship with the lowermost cup of the stack extending outwardly of the bottom of the housing 12 through a center opening in the diaphragm member 14. This general overall arrangement is well known and is shown in several prior U.S. patents such as, for example, U.S. Pat. Nos. 4,925,058; 1,155 562; 1,808,284; and 3,211,329.

As discussed earlier, problems with the apparatus of the general type under consideration have been concerned with the inability of the diaphragm members to handle a wide range of cup sizes. That is, a relatively large range of diaphragms with differing center hole diameters were required in order to handle the typical range of cup sizes ordinarily encountered.

In accordance with the subject invention, the diaphragm has a particular improved design and arrangement such that it can readily adapt and function with cups having widely differing overall shapes and diameters. While the diaphragm member itself could have many different specific embodiments, the preferred shape and embodiment is illustrated best in FIGS. 2 through 4. As illustrated therein, the diaphragm 14 is formed from a resilient, elastic, elastomeric material such as silicone rubber or a polymeric material sold under the trademark KATON G. Preferably, the diaphragm has a generally circular peripheral configuration as illustrated which is sized to be received on the lower end of the tubular member 18. Any convenient manner for firmly connecting the diaphragm to the tube could be used such as the upwardly extending integral flange 20 and the circumferentially extending clamp ring 16 previously mentioned.

Preferably, the diaphragm member 10 molded as a single unitary piece and has a circular center opening 22 extending therethrough. The opening or hole 22 has a diameter slightly smaller than the maximum diameter of the minimum cup or container element to be handled and dispensed by the assembly. The design of the membrane 14 and the and the features which are believed to produce the improved results can best be understood by reference to FIGS. 3, 3A, 3B, and 4. As specifically illustrated therein, the diaphragm member 14 is constructed and arranged such that its resistance to elongation in circumferentially extending bands of the diaphragm about the center opening 22 are such that there is a constantly increasing resistance to elongation as one proceeds radially outward. This is somewhat diagrammatically shown through the use of individual circumferential bands designated by dot-dash lines in FIG. 4. The arrows diagrammatically show this feature with the increasing length of the arrows representing the increased force necessary to produce a predetermined elongation for a unit of band length with a unit of force applied. More particularly, the membrane is constructed so that as we proceed radially outward significantly greater forces are required to produce elongation and circumferential stretching of the diaphragm to permit larger cups to pass through the center.

Figure 3:
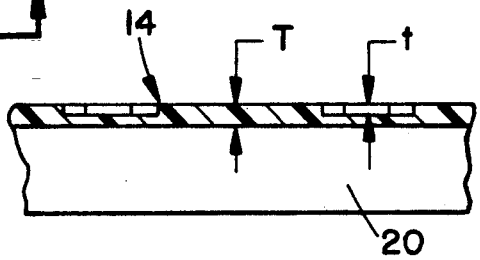
FIGS. 3, 3A, and 3B are cross-sectional views taken on lines 3, 3A, and 3B of FIG. 2, respectively.
Figure 2:
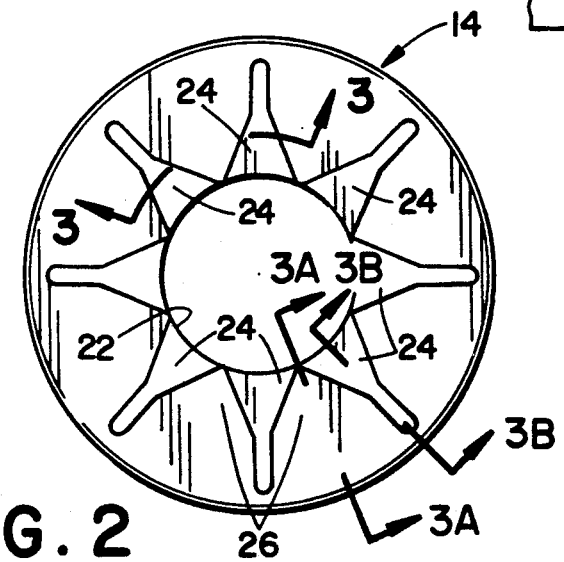
FIG. 2 is a bottom view taken on line 2—2 of FIG. 1 and showing the membrane or diaphragm member used in the FIG. 1 apparatus.
Figure 3A:
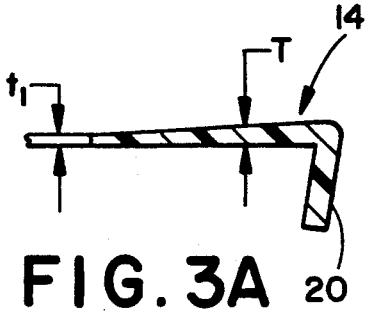
Figure 3B:
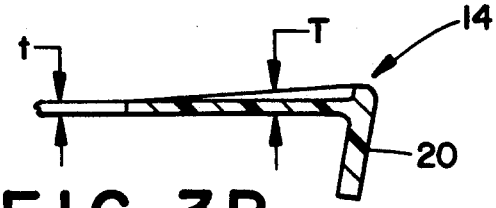
Figure 4:
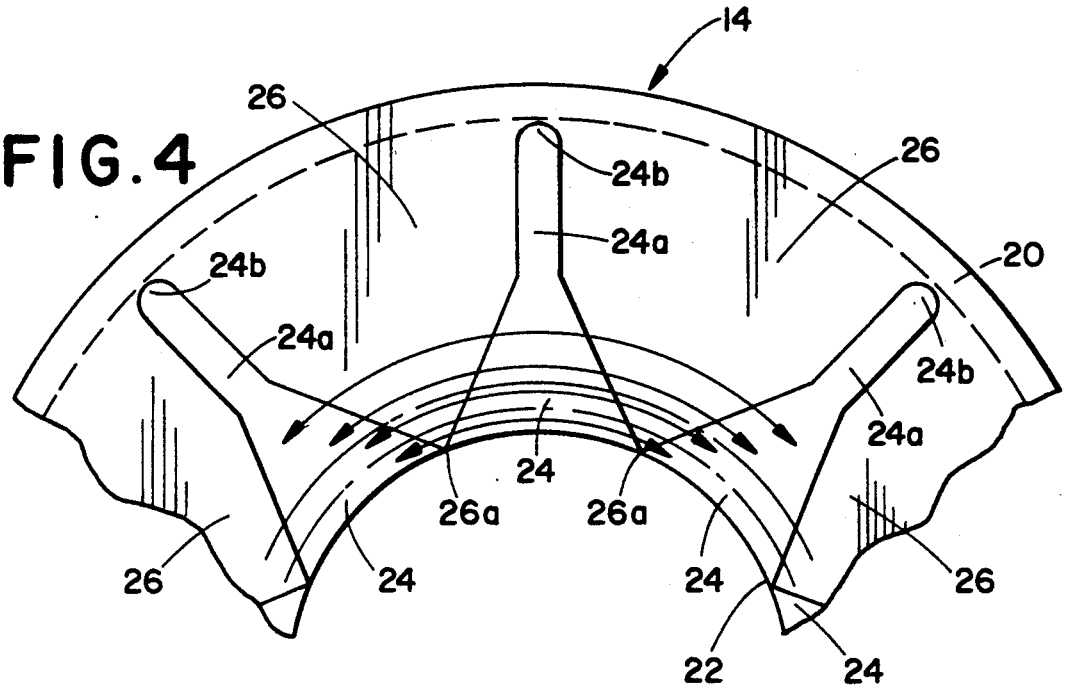
FIG. 4 is a greatly enlarged, partial view of FIG. 2 for the purpose of illustrating the nature of the preferred form of the diaphragm or membrane member.

Many different designs can achieve the desired relationships. In the subject embodiment, the desired relationships are achieved through the use of alternate thick and thin radially extending bands of diaphragm material. As illustrated, the diaphragm comprises relatively thin, uniform thickness sections 24 which have a thickness "t" as shown in FIGS. 3, 3A, and 3B. Each of the sections 24 preferably has a generally triangular shape in plan view as shown in FIGS. 2 and 4. Additionally, at the outer apex of each of the triangular shapes there is, as illustrated, a relatively narrow section 24*a* of uniform width which terminates in a circular outer end 24*b*.

Each of the sections 24 is separated by an intermediate thicker section 26 which has a narrow radially inner point portion 26*a*. As best illustrated in FIGS. 3A and 3B the sections 26 are thicker than the intermediate sections 24 and increase in thickness from a thickness "$t_1$" at the inner end 26*a* to a thickness "T" in the outer peripheral portion as shown. Because of the shapes of the alternate thick and thin sections 24 and 26, as well as because of the increase in thickness in a radial direction of the sections 26, the results of the particular shapes are as previously discussed with respect to the increasing resistance to elongation as one proceeds radially outward from the opening 22. Additionally, the thick sections 26 provide a series of higher contact pressures in the nature of a series of circumferential inwardly extending engagement fingers. It should also be noted as best seen in FIGS. 3 through 3B that the inner surface of the diaphragm which engages the outer surface of the stack of cups is flat and relatively smooth. That is, the thick and thin portions are produced by variations inwardly from the outer surface of the membrane member.

FIGS. 7 and 8 give the preferred dimensional relationships for the various component portions of the preferred embodiment of the membrane. This embodiment is designed for handling cups or containers in a range of sizes from 2½ inches to 3½ inches. Additionally, these dimensions are, of course, capable of wide variation and, in fact, it should be possible to produce diaphragms having the desired characteristic with a variety of different shapes in the alternate thick and thin sections or through the use of different arrangements and thickness variations so long as the preferred gradual increasing in resistance to circumferential elongation results.

Figure 5:
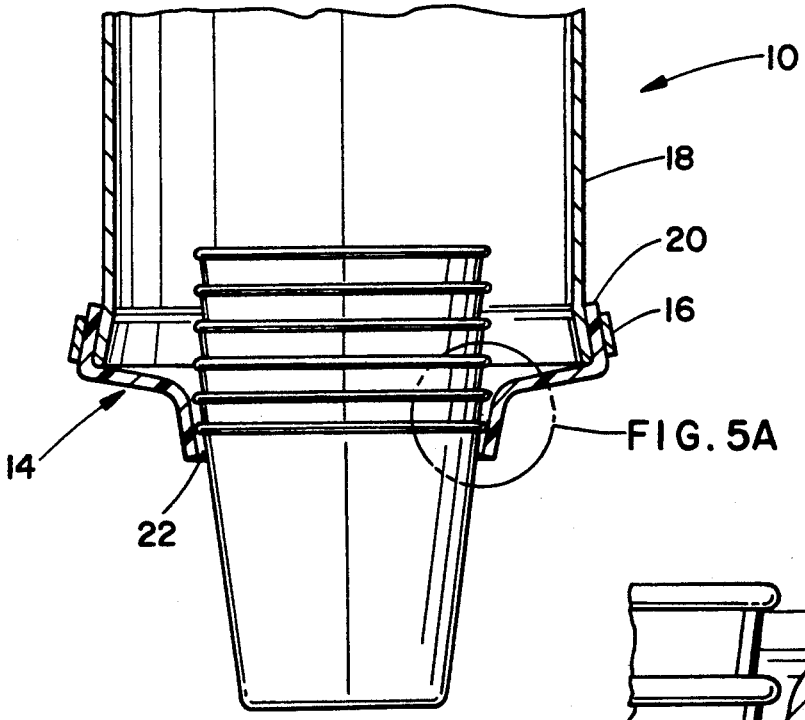
FIG. 5 is a cross-sectional view through the bottom end of the cup dispensing apparatus showing a stack of cups in storage and dispensing position in the apparatus.
Figure 5A:
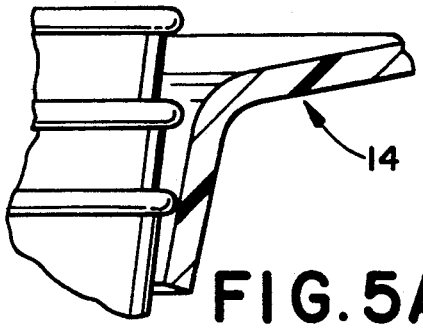
FIG. 5A is a greatly enlarged view of the circled portion of FIG. 5.
Figure 6:
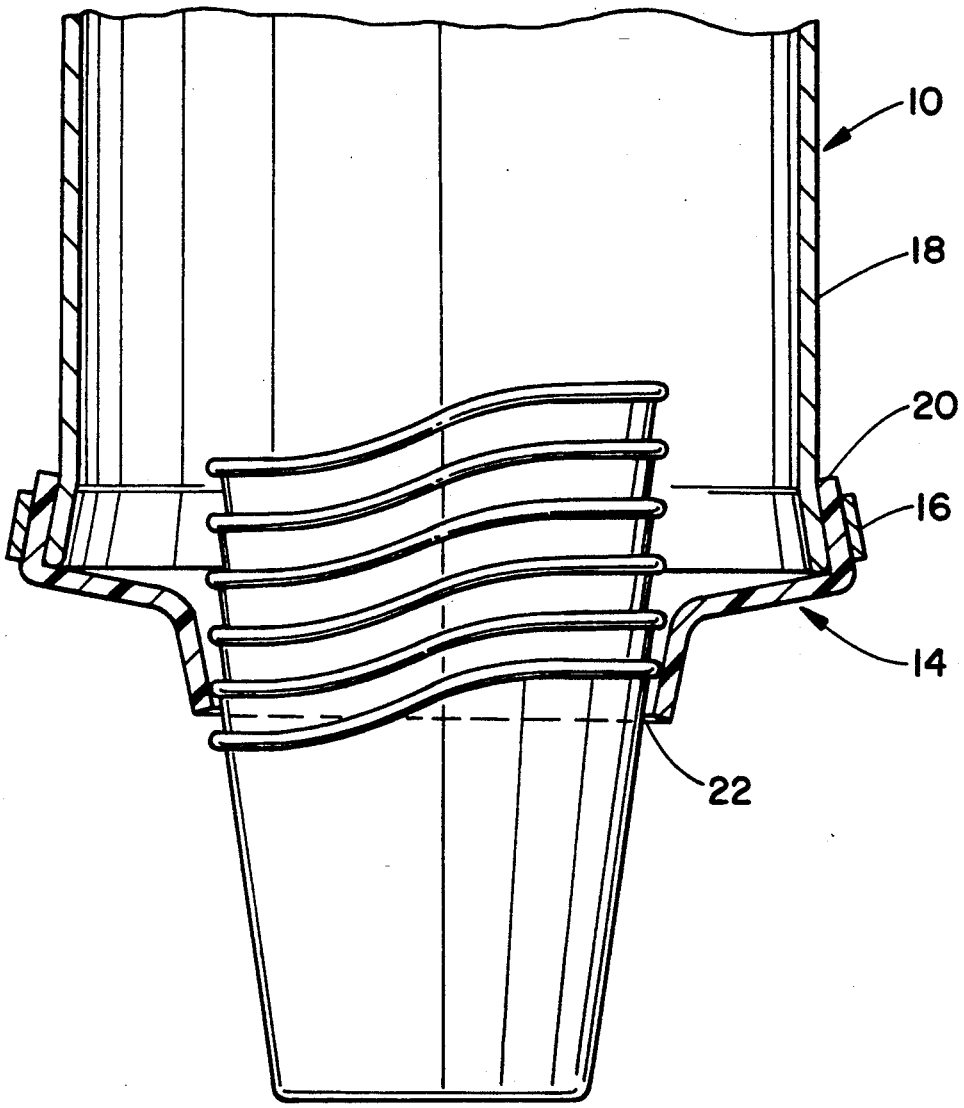
FIG. 6 is a view similar to FIG. 5 but showing a stack of cups having an asymmetrical upper edge positioned in the storage and dispensing apparatus.

FIGS. 5 and 6 illustrate the functioning of the device of the invention. Specifically, referring first to FIG. 5, it will be noted that when used with a relatively standard cup or container configuration, the center opening 22 is deformed in the manner shown and the membrane elongates downwardly in a tubular form to engage the rim of the lowermost cup and the rims of one or more superjacent cups. The pressure exerted against the various rims varies from a minimum at the lowest end of the tubular deformed section to a maximum at the upper portion. Thus, it is possible to pull the lower cup from the stack while the stack is retained through the higher pressure engagement of the membrane with the upper rims. This results from the varying resistance to elongation present in the diaphragm. Additionally, this resistance which varies from a minimum at the inner peripheral edge to a significantly greater maximum at the outer diameters is such that a wide variety in diameters of cups can be handled by the individual membrane designs. In addition, referring to FIG. 6, it will be seen that the same diaphragm can handle cups which have an upper edge which is asymmetrical. The nature of the membrane results in a maximum engagement pressure being present along the portion of the lip which is engaging the lowermost cup and a somewhat lesser engagement pressure along the superposed cups. As the lowermost cup exits from beneath the lip. However, a transfer of the point of maximum engagement takes place to the next adjacent superjacent cup.

As a result of the factors discussed above, the diaphragms of the subject invention are extremely efficient and have a relatively long life when designed and used as described.

Figure 9:
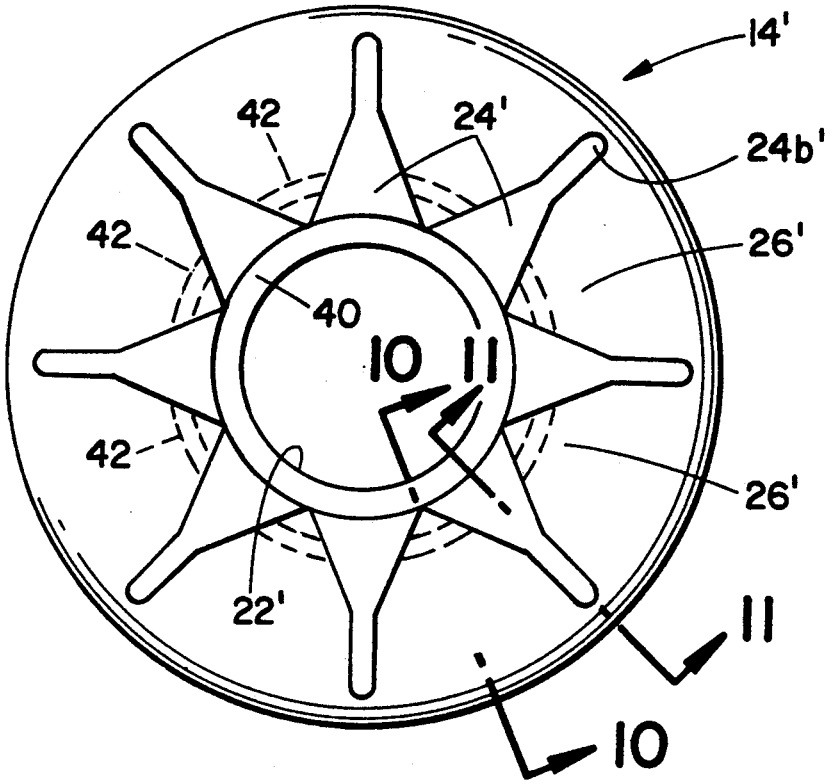
FIG. 9 is a view like FIG. 2 showing a second embodiment of the invention.
Figure 10:
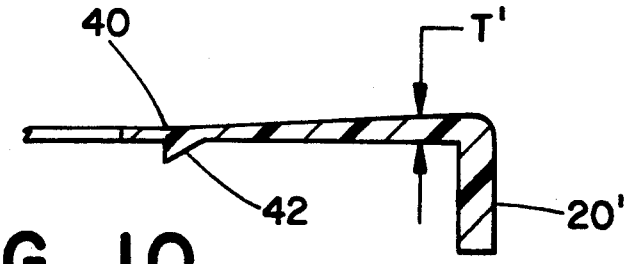
FIGS. 10 and 11 are cross-sectional views taken on lines 10—10 and 11—11 of FIG. 9.
Figure 11:
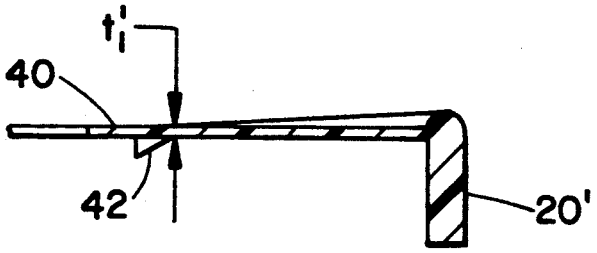

FIGS. 9–11 illustrate a second embodiment of the invention. In this embodiment, like elements have been identified with the same numerals used with respect to the FIGS. 1–8 embodiment but differentiated therefrom by a prime suffix. In the 9–11 embodiment, the diaphragm 14' has the same general shape and construction as previously described with the alternately positioned thick and thin sections 24' and 26' shaped as shown. However, about the periphery of the opening 22', there is a narrow rim or lip 40 which is of constant thickness circumferentially thereof. Additionally, the rim 40 preferably has a smooth, planar surface on both the upper and lower surfaces.

Associated with the lip 40 are a plurality of small tabs or detent-like members 42 which have a generally wedge shape in cross section as best seen in FIG. 10. The members 42 are preferably equally spaced circumferentially about opening 22' by being located on the radial inner end of each section 26' as shown by FIG. 9. The radial inner surface of each member 42 is spaced a short distance outward from the periphery of opening 22'. The distance is chosen to approximate the position of the upper edge of the first remaining container in the stack as the lowermost container is being removed. The members 42 provide a slightly increased pressure and improved gripping of the first remaining container so that it will remain in the dispenser even when it has a relatively high frictional engagement with the lowermost container.

The invention has been described in great detail sufficiently one of ordinary skill in the are to make and use the same. Obviously, modifications and alterations of the preferred embodiment will appear to others upon a reading and understanding of the subject specification.

Having thus discussed the invention, it is now claimed:

1. In an apparatus for storing a supply of containers having an open upper end and a generally conical side wall tapering to a smaller bottom end, said apparatus comprising a housing for maintaining the containers in a stacked telescopically interfitted relationship and including a resilient diaphragm having an opening through which the lowermost container of said stack extends and which diaphragm acts to retain said stack in the housing while permitting the lowermost container to be withdrawn, the improvement wherein said diaphragm comprises a unitary piece of resilient elastomeric material with the diaphragm continuous about the opening and having a variable thickness to produced a resistance to elongation in directions circumferentially of the opening which increases progressively radially outward of the opening.

2. The apparatus as defined in claim 1 wherein the resistance to elongation results from forming the diaphragm such that the average thickness in circumferential bands about the opening increases progressively radially outward of the opening.

3. In an apparatus for storing a supply of containers having an open upper end and a generally conical side wall tapering to a smaller bottom end, said apparatus comprising a housing for maintaining the containers in a stacked telescopically interfitted relationship and including a resilient diaphragm having an opening through which the lowermost container of said stack extends and which diaphragm acts to retain said stack in the housing while permitting the lowermost container to be withdrawn, the improvement wherein said diaphragm comprises a unitary piece of resilient elastomeric material with the diaphragm having a resistance to elongation in directions circumferentially of the opening which increases progressively radially outward of the opening and wherein the diaphragm is comprised of radially extending sections which are alternately relatively thick and relatively thin circumferentially of the opening.

4. The apparatus as defined in claim 3 wherein the relatively thick sections are of tapering width and increase in width as they progress radially outward from the opening.

5. The apparatus as defined in claim 4 wherein the relatively thick sections are of increasing thickness as they progress radially outward from the opening and have a triangular shape in plan view.

6. The apparatus as defined in claim 3 wherein the relatively thin sections are each of substantially uniform thickness and have a triangular shape in plan view.

7. The apparatus as defined in claim 3 wherein the relatively thin sections are of tapering width and decrease in width as they progress radially outward from the opening.

8. The apparatus as defined in claim 7 wherein the opening is circular and the relatively thin sections are each of uniform thickness.

9. The apparatus as defined in claim 7 wherein the relatively thick sections terminate in a relatively narrow point closely adjacent the opening.

10. A diaphragm member for use in a cup storage and dispensing apparatus comprising:

a diaphragm formed from a resilient, highly elastic material and having a central opening with a continuous periphery, said diaphragm radially outward of the opening being a continuous unitary web extending circumferentially of said opening;

said unitary web being defined by generally radially extending sections with a set of first section that are relatively thin and have a relatively low resistance to elastic elongation and a set of second sections that are relatively thick and have a comparatively high resistance to elastic elongation, said first sections and said second sections being integrally joined and positioned alternately about said opening with the width of the second sections increasing radially outwardly of the opening.

11. The diaphragm member as define in claim 10 wherein the width of the first sections decrease radially outward of the opening.

12. The diaphragm member as defined in claim 11 wherein the second sections each have the general shape of an isosceles triangle with the apex of the angle between the equal legs located generally at the periphery of the opening.

13. The diaphragm member as defined in claim 12 wherein the opening is circular and the second sections are each positioned so that the bisector of the angle between their equal legs generally constitutes a continuation of a radius of the opening.

14. A diaphragm member for use in a storage and dispensing apparatus for telescopically interfitted stacks of conically shaped containers comprising:

a continuous, integral sheet of a resilient, highly elastic material;

an opening in he central area of the sheet with the periphery of said opening being continuous;

said sheet having variable thickness portions arranged such that the resistance to elongation of said sheet increases in a proportional relationship to the radial distance from the periphery of the opening; and, wherein the variable thickness of said sheet is provided by radially extending sections of relatively thick and relatively thin sections which are integrally joined in alternative relationship about the opening.

15. A diaphragm member as defined in claim 14 wherein the relatively thick sections increase in width progressively radially outward of the opening.

16. A diaphragm member as defined in claim 15 wherein said thin sections decrease in width progressively radially outward of the opening.

17. A diaphragm member as defined in claim 16 wherein at least each alternate individual section is of substantially constant thickness.

18. A diaphragm member as defined in claim 14 wherein the opening in the central area of the sheet is defined by an inner periphery of the sheet having a constant thickness over a short radial distance.

19. A diaphragm member for use in a storage and dispensing apparatus for telescopically interfitted stacks of conically shaped containers comprising:

a continuous, integral sheet of a resilient, highly elastic material;

an opening in the central area of the sheet with the periphery of said opening being continuous;

said sheet having variable thickness portions arranged such that the resistance to elongation of said sheet increases in a proportional relationship to the radial distance from the periphery of the opening; and, further including a plurality of tabs extending axially of said opening at a closing spaced distance from the periphery thereof.

20. A diaphragm member as defined in claim 19 wherein said tabs are located at generally evenly spaced locations about the circumference of said opening.

* * * * *